US007039348B2

(12) United States Patent
Kerxhalli et al.

(10) Patent No.: US 7,039,348 B2
(45) Date of Patent: May 2, 2006

(54) METHOD FOR MAINTAINING IMAGE ON IMAGE AND IMAGE ON PAPER REGISTRATION

(75) Inventors: David M. Kerxhalli, Rochester, NY (US); Keith A. May, Palmyra, NY (US); Brian R. Conrow, Rochester, NY (US); Michael J. Martin, Hamlin, NY (US); Michael J. Thomas, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 347 days.

(21) Appl. No.: 10/630,063

(22) Filed: Jul. 30, 2003

(65) Prior Publication Data

US 2004/0114025 A1 Jun. 17, 2004

Related U.S. Application Data

(60) Provisional application No. 60/434,180, filed on Dec. 17, 2002.

(51) Int. Cl.
*G03G 15/01* (2006.01)

(52) U.S. Cl. ..... 399/301; 347/116; 346/116; 399/38; 399/39; 399/40

(58) Field of Classification Search ..... 399/301
See application file for complete search history.

(56) References Cited

U.S. PATENT DOCUMENTS

| | | | | |
|---|---|---|---|---|
| 4,611,901 | A | 9/1986 | Kohyama et al. | 355/4 |
| 4,660,059 | A | 4/1987 | O'Brien | 346/157 |
| 4,833,503 | A | 5/1989 | Snelling | 355/259 |
| 5,642,202 | A | 6/1997 | Williams et al. | 358/406 |
| 5,821,971 | A | 10/1998 | Rauch et al. | 347/134 |
| 5,889,545 | A | 3/1999 | Rauch et al. | 347/134 |
| 6,137,517 | A | 10/2000 | Furst et al. | 347/116 |
| 6,141,464 | A | 10/2000 | Handley | 382/287 |
| 6,178,031 | B1 | 1/2001 | Rauch et al. | 359/216 |
| 6,275,244 | B1 | 8/2001 | Omelchenko et al. | 346/116 |
| 6,300,968 | B1 | 10/2001 | Kerxhalli et al. | 347/116 |
| 6,429,886 | B1 * | 8/2002 | Ohki | 347/115 |
| 6,452,147 | B1 * | 9/2002 | Inada | 250/208.1 |
| 6,763,199 | B1 * | 7/2004 | Conrow et al. | 399/15 |
| 2003/0002891 | A1 * | 1/2003 | Metzler et al. | 399/301 |

OTHER PUBLICATIONS

Kerxhalli, et al; Systems and Methods for One-Step for Image on Paper Registration, U.S. Appl. No. 10/630,073, filed Jul. 30, 2003, 36 pages.

* cited by examiner

*Primary Examiner*—Arthur T. Grimley
*Assistant Examiner*—Ryan D. Walsh
(74) *Attorney, Agent, or Firm*—Joseph M. Young

(57) ABSTRACT

A method for repositioning a mark on a belt after an image on paper registration process, which includes printing a test pattern, measuring at least one test pattern parameter, detecting a mark on a belt and detecting at least one imaging error associated therewith, using the at least one test pattern parameter and the at least one imaging error to determine the lateral distance required to shift a particular image to a desired location on the belt and shifting the image to the desired location.

12 Claims, 5 Drawing Sheets

METHOD FOR MAINTAINING IMAGE ON IMAGE AND IMAGE ON PAPER REGISTRATION

This application is based on Provisional Patent Application No. 60/434,180, filed Dec. 17, 2002.

In various reproduction systems, including xerographic printing, the control and registration of the position of imageable surfaces such as photoreceptor belts, intermediate transfer belts (if used), or images thereon, is critical, and a well developed art, as shown by the exemplary patents cited below. It is well known to provide various single or dual axes control systems, for adjusting or correcting the lateral position or process position or timing of a photoreceptor belt or other image bearing member of a reproduction apparatus, such as by belt lateral steering systems or belt drive motor controls, or adjusting or correcting the lateral position or process position or timing of the placing of images on the belt with adjustable image generators such as laser beam scanners.

An important application of such accurate image position or registration systems is to accurately control the positions of different colors being printed on the same intermediate or final image substrate, to insure the positional accuracy (adjacency or overlapping) of the various colors being printed. That is not limited to xerographic printing systems. For example, precise registration control may be required over different ink jet printing heads or vacuum belt or other sheet transports in a plural color ink jet printer.

It is well known to provide, image registration systems for the correct and accurate alignment, relative to one another, on both axes (the lateral axis or the process direction axis), of different plural color images on an initial imaging bearing surface member such as (but not limited to) a photoreceptor belt of a xerographic color printer. That is, to improve the registration accuracy of such plural color images relative to one another or to the image bearing member, so that the different color images may be correctly and precisely positioned relative to one another or superposed and combined for a composite or full color image, to provide for customer-acceptable color printing on a final image substrate such as a sheet of paper. The individual primary color images to be combined for a mixed or full color image are often referred to as the color separations.

Known means to adjust the registration of the images on either or both axes relative to the image bearing surface and one another include adjusting the position or timing of the images being formed on the image-bearing surface. That may be done by control of ROS (raster output scanner) laser beams or other known latent or visible image forming systems.

In particular, it is known to provide such imaging registration systems by means of marks-on-belt (MOB) systems, in which edge areas of the image bearing belt laterally outside of its normal imaging area are marked with registration positional marks, detectable by an optical sensor. For belt steering and motion registration systems (previously described) such registration marks can be permanent, such as by silk screen printing or otherwise permanent marks on the belt, such as belt apertures, which may be readily optically detectable. However, for image position control relative to other images on the belt, or the belt position, especially for color printing, typically these registration marks are not permanent marks. Typically they are distinctive marks imaged with, and adjacent to, the respective image, and developed with the same toner or other developer material as is being used to develop the associated image, in positions corresponding to, but outside of, the image position. Such as putting the marks along the side of the image position or in the inter-image zone between the images for two consecutive prints. Such marks-on-belt (MOB) image position or registration indicia are thus typically repeatedly developed and erased in each rotation of the photoreceptor belt. It is normally undesirable, of course, for such registration marks to appear on the final prints (on the final image substrate).

Color registration systems for printing, as here, should not be confused with various color correction or calibration systems, involving various color space systems, conversions, or values, such as color intensity, density, hue, saturation, luminance, chrominance, or the like, as to which respective colors may, be controlled or adjusted. Color registration systems, such as that disclosed herein, relate to positional information and positional correction (shifting respective color images laterally or in the process direction or providing image rotation or image magnification) so that different colors may be accurately superposed or interposed for customer-acceptable full color or intermixed color or accurately adjacent color printed images. The human eye is particularly sensitive to small printed color misregistrations of one color relative to one another in superposed or closely adjacent images, which can cause highly visible color printing defects such as color bleeds, non-trappings (white spaces between colors), halos, ghost images, etc.

Various systems and methods have been developed to control registration of image on paper after an initial registration has been made. Examples of such registration systems include those shown and described in U.S. Pat. Nos. 5,821,971; 5,889,545; 6,137,517; 6,141,464; 6,178,031; 6,275,244; and 6,300,968; the subject matter of each of the preceding patents is hereby incorporated herein in its entirety.

U.S. Pat. No. 5,642,202, the subject matter of which is incorporated herein by reference in its entirety, discloses a process for initial registration calibration of a printing system including a printer and a master test image document printed by the printer.

This invention is directed to systems and methods for setting up and maintaining image on paper (IOP) registration while maintaining image on image (IOI) registration in a printing device.

There are a number of sources of image on sheet or image on paper (IOP) registration errors which may be addressed, including lateral magnification, lateral margin shifts, process margin shifts, paper skew or imager skew. Lateral magnification is the magnification of the image in the lateral direction, i.e., in the direction substantially perpendicular to the process direction.

The lateral margins are the spaces between each edge of the image transferred to and developed on the substrate and each adjacent edge of the substrate that is substantially parallel to the process direction. The process margins are the spaces between each edge of the image transferred to and developed on the substrate and each adjacent edge of the substrate that is substantially perpendicular to the process direction. It should be noted that, in many xerographic image-forming devices, each image is exposed successively by one or more raster output scanner imagers. Each raster output scanner has a start of scan (SOS) sensor and an end of scan (EOS) sensor. The SOS and EOS sensors, along with the delay before the first pixel is imaged after the start of scan occurs, and the associated timing of when the start of scan occurs, establish the lateral and process margins of a latent image which is to be developed and transferred to a substrate.

The term "reproduction apparatus" or "printer" as alternatively used herein broadly encompasses various printers, copiers or multifunction machines or systems, xerographic or otherwise, unless otherwise indicated or defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy". A "print job" is normally a set of related sheets, usually one or more collated copy sets copied from a set of original document sheets or electronic document page images, from a particular user, or otherwise related.

As to specific components of the subject apparatus or methods, or alternatives therefor, it will be appreciated that, as is normally the case, some such components are known per se in other apparatus or applications that may be additionally or alternatively used herein, including those from art cited herein. All references cited in this specification, and their references, are incorporated by reference herein where appropriate for teachings of additional or alternative details, features, or technical background. What is well known to those skilled in the art need not be described herein.

Embodiments include a method for repositioning a mark on a belt after an image on paper registration process, which includes printing a test pattern, measuring at least one test pattern parameter, detecting a mark on a belt and detecting at least one imaging error associated therewith, using the at least one test pattern parameter and the at least one imaging error to determine the lateral distance required to shift a particular image to a desired location on the belt, and shifting the image to the desired location.

The embodiments will be described in detail herein with reference to the following figures in which like reference numerals denote like elements and wherein.

Figure 1:
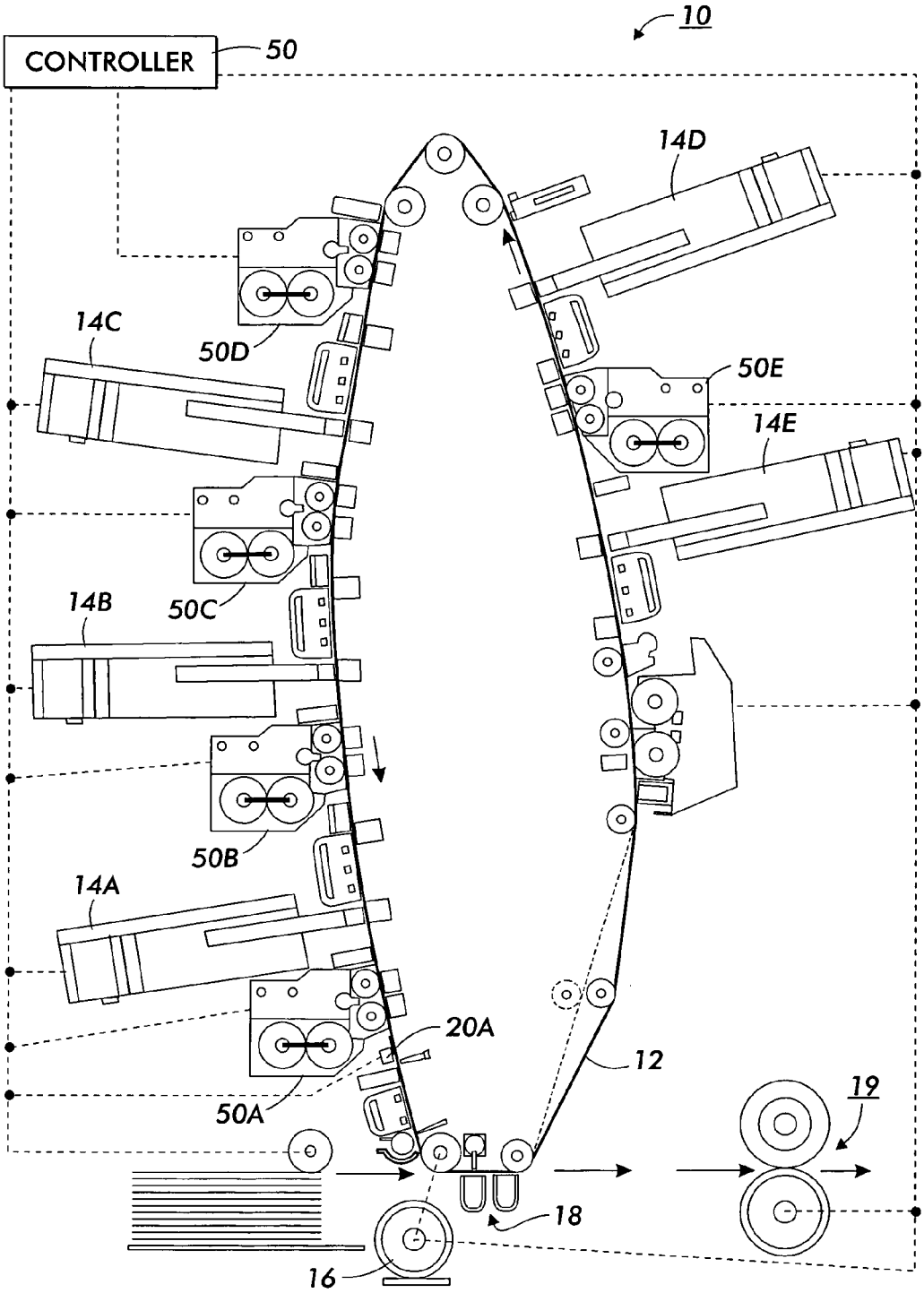
FIG. 1 is a schematic frontal view of one example of a reproduction system for incorporating one example of the subject registration system, in this case, a color-on-color xerographic printer.

FIG. 1 schematically illustrates a, printer 10 as one example of an otherwise known type of xerographic, plural color "image-on-image" (IOI) type full color (cyan, magenta, yellow and black imagers) reproduction machine, merely by way of one example of the applicability of the current cursor correction system. A partial, very simplified, schematic perspective view thereof is provided in FIG. 2. This particular type of printing is also referred as "single pass" multiple exposure color printing. It has plural sequential ROS beam sweep PR image formations and sequential superposed developments of those latent images with primary color toners, interspersed with PR belt re-charging. Further examples and details of such IOI systems are described in U.S. Pat. Nos. 4,660,059; 4,833,503; 4,611,901; etc.

However, it will be appreciated that the disclosed improved registration system could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer it will be appreciated the image bearing member on which the subject registration marks are formed may be either or both on the photoreceptors and the intermediate transfer belt, and have MOB sensors and image position correction systems appropriately associated therewith. Various such known types of color printers are further described in the above-cited patents and need not be further discussed herein.

Figure 2:
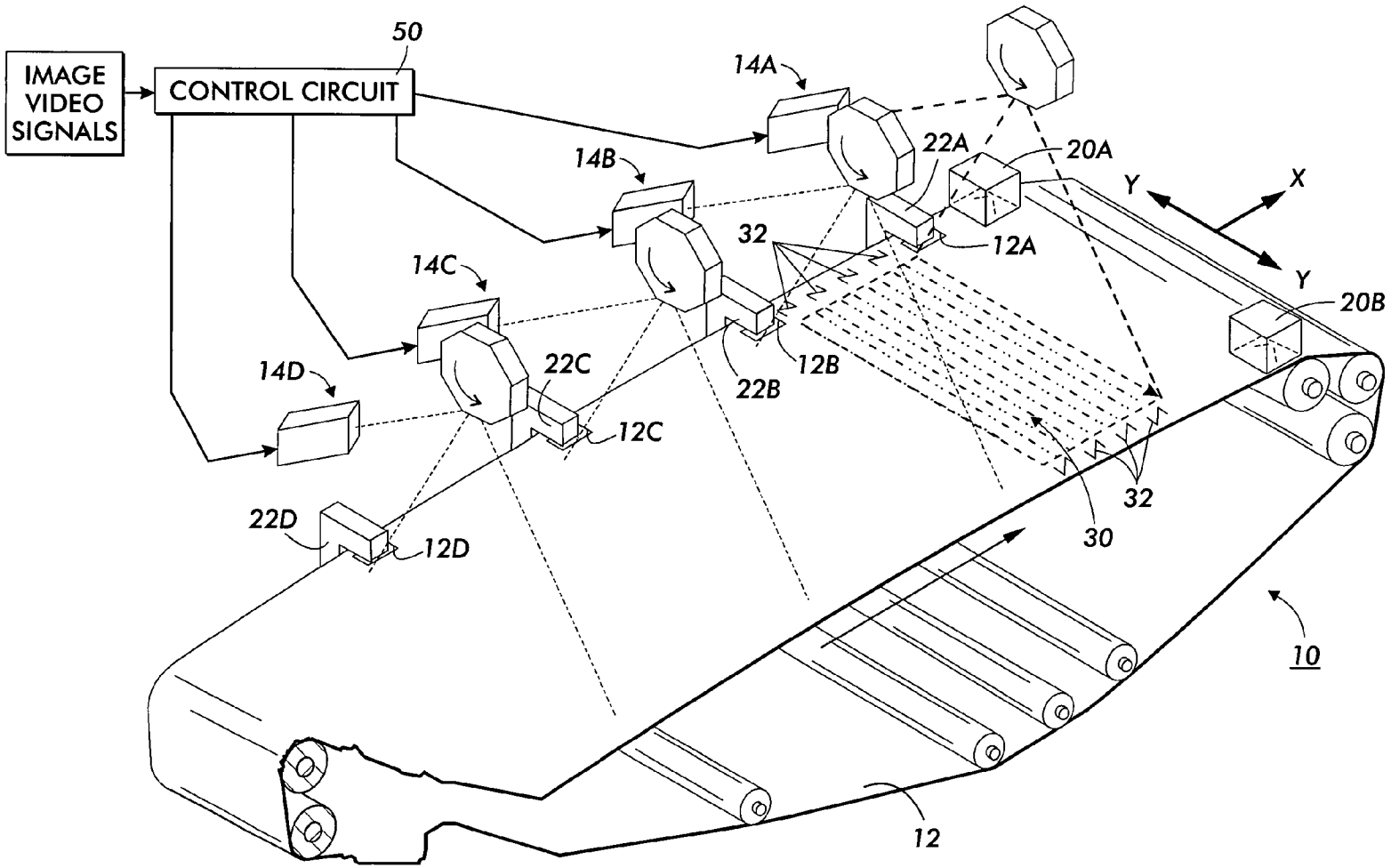
FIG. 2 is a simplified schematic perspective view of part of the embodiment of FIG. 1 for better illustrating exemplary sequential ROS generation of plural color latent images and associated exemplary latent image registration marks for MOB sensing (with development stations, etc., removed for illustrative clarity).

Referring to the exemplary printer 10 of FIGS. 1 and 2, all of its operations and functions may be controlled by programmed microprocessors, as described above, at centralized, distributed, or remote system-server locations, any of which are schematically illustrated here by the controller 50. A single photoreceptor belt 12 may be successively charged, ROS (raster output scanner) imaged, and developed with black or any or all primary colors toners by a plurality of imaging stations. In this example, these plural imaging stations include respective ROS's 14A, 14B, 14C, 14D, and 14E; and associated developer units 50A, 50B, 50C, 50D, and 50E. A composite plural color imaged area 30, as shown in FIG. 2, may thus be formed in each desired image area in a single revolution of the belt 12 with this exemplary printer 10, providing accurate registration can be obtained. Two MOB sensors (20A in FIG. 1, 20A and 20B in FIG. 2) are schematically illustrated, and will be further described herein concerning such registration.

In embodiments, developer units 50A–D are used to develop black, cyan, yellow, and magenta, respectively. These images are developed successively on the photoreceptor belt before being transferred to a sheet of paper.

The belt 12 has a conventional drive system 16 for moving it in the process direction shown by its movement arrows. A conventional transfer station 18 is illustrated for the transfer of the composite color images to the final substrate, usually a paper sheet, which then is fed to a fuser 19 and outputted.

Referring to FIG. 2, it may be seen that registration holes 12A, 12B, 12C, 12D, etc., (or other permanent belt marks, of various desired configurations) may also be provided along one or both edges of the photoreceptor belt 12. These holes or marks may be optically detected, such as by belt hole sensors, schematically shown in this example in FIG. 2 as 22A, 22B, 22C, 22D. Various possible functions thereof are described, for example, in the above-cited patents. If desired, the holes or other permanent belt markings may be located, as shown, adjacent respective image areas, but it is not necessary that there be such a mark for each image position, or that there be plural sensors. Also, the number, size and spacing of the image areas along the photoreceptor belt may vary in response to various factors including, for example, when larger or smaller images are being printed.

In FIG. 2 it may be seen that toner registration mark images 32 have been formed along both sides of the printer 10 photoreceptor belt 12, adjacent but outside of its imaged area 30, as will be further described. However, those "Z" marks 32 can be replaced with chevron-shaped toner registration mark images 34A–F, such as those shown in FIG. 5, or expanded chevrons as shown and described in U.S. Pat. No. 6,300,968, issued Oct. 9, 2001 (the '968 Patent). Examples of other types of MOB are given in the '968 patent as well. The particular shape of the marks is not important to the present invention. These marks are used to ensure that images drawn on the bait at different stations are aligned with each other, and particularly to ensure that each color is drawn in the appropriate place. When printing multi-color documents it is important to keep the colors aligned.

MOB registration marks corresponding to different toner colors are imaged and developed in close alignment both with respect to each other and with respect to the MOB sensors 20A, 20B. U.S. Pat. No. 6,275,244 discloses an exemplary image-on-image (IOI), or color on color, registration setup system, the subject matter of which has already been incorporated in its entirety. The IOI registration setup aligns the MOB registration marks 32 along the sides of the belt with the MOB sensors 20A, 20B. After IOI registration setup has been performed, all the colors—magenta, yellow, cyan, and black—are aligned to each other, and the MOB registration marks are centered under the MOB sensors. An exemplary registration system includes the following elements: an initial image registration or setup mode, an expanded chevron registration mode, and a standard regular or fine registration mode.

An initial image registration or setup mode, which can provide initial registration even from a gross initial misregistration. Initial gross color images misregistration can exist, for example, when the machine is first run after manufacturing, or after a service call, after a ROS repair, after a PR belt change, etc. In such cases the initial lateral position of each color image area, and thus its directly associated MOB position on the PR belt 12, could be out of registration by +/−3 mm, for example. If the MOB sensor 20A or 20B has a lateral sensing range for a standard chevron belt mark target 34 of less than 1 mm, it will not provide registration of such an out-of-registration target. In order to insure that the MOB sensors "see" each color registration mark 34 in this initial state (the image registration setup mode), there is provided an initial generation, during this initial state only, of "Z" shaped color registration marks (for example, registration marks 32 in FIG. 2), providing the MOB sensors with a greater lateral sensing range, instead of chevron shaped marks such as 34A–F. Appropriate initial use of such "Z" marks instead of chevron marks on the belt for initial registration can increase the lateral sensing range of the MOB sensors in that mode of operation by an order of magnitude, e.g., from approximately +/−1 mm for chevron marks to approximately +/−10 mm for "Z" marks. This can avoid manual initial adjustments to get the registration within the sensing and control range of the MOB sensors. To express that another way, avoiding "open loop" adjustment situations where the otherwise desired chevron registration marks are out of range and not detectable.

Also, an "expanded chevrons" registration mode may be additionally provided if desired between the gross registration phase and the standard chevron phase. In this mode, the chevron marks may comprise wider than normal chevrons of different colors for improved initial registration in the process direction. Due to initial misregistration tolerances, lead edge (process direction) misregistration may initially be too large for the standard size chevrons ensemble or set, so that such an expanded chevron mode of operation may be initially desirable. The expanded chevron mode can be used to refine and adjust the position of the cyan or other registration baseline image offsets.

This optional "expanded chevron" step or mode provides a target pattern that will allow a coarse color registration adjustment. That is, this mode provides a different target that will allow the marks-on-belt sensor to detect the position of each color even if there is a large amount of process direction error between the colors. The MOB sensors may not readily detect color positions with the standard size chevrons ensemble if there is a large amount of process registration error between the colors, because the marks may be nominally too close together. In the expanded chevron ensemble, however, the marks are spaced out sufficiently in the process direction so that there is no overlap of colors in the presence of large process direction errors. For example, by providing an expanded chevron dimension in the process direction of about 7.4 mm as opposed to a normal chevron dimension in the process direction of about 0.72 mm. However, the angles of the legs of these expanded chevrons may remain the same. The transverse dimension (widths) of these chevrons may also be the same, e.g., about 10.4 mm.

This initial or gross registration mode or step is then followed by switching to a standard regular or fine registration mode or step of developing standard chevron shaped registration marks on the photoreceptor belt, as taught in the above-cited and other patents. Both of these different sets of different marks may provide the MOB registration marks for the registrations of the different colors of a plural color printer.

These steps are repeated until the positions of the different color registration marks are substantially aligned with each other and with the MOB sensors.

After IOI registration has been setup, image to paper (IOP) registration must be setup. Paper, as used herein, refers to a variety of substrates on which images and text may be printed. In order to adjust Image to Paper registration (IOP registration setup), the operator makes measurements of an image on a sheet of paper. The system adjusts the position of the image and the paper during an IOP Registration Setup. An exemplary IOP registration setup process is described In U.S. patent application Ser. No. 10/046,166, filed Jan. 16, 2002, now U.S. Pat. No. 6,763,199, issued Jul. 13, 2004: entitled "SYSTEMS AND METHODS FOR ONE-STEP SETUP FOR IMAGE ON PAPER REGISTRATION," hereby incorporated in its entirety. When the IOP registration setup has been completed, the image is aligned with the paper, but the image has moved away from the center of the MOB sensors. When the image position is adjusted during IOP registration setup, the entire image, including the MOB registration marks 32, is distorted to end up in the correct place on the paper. The lateral (inboard to outboard) position of the image is shifted and the lateral magnification of the image, which is the size of the image from inboard to outboard, is changed. These changes affect the position of all images that are printed on the photoreceptor, including the MOB registration marks 32.

The IOP setup routine shifts the lateral margins of each separation in order to align the image and the paper in the lateral direction. Also, the lateral magnification of each separation is adjusted during IOP setup, in order to affect the absolute lateral magnification on the paper. As the lateral margins and magnifications are shifted, the color registration targets are also shifted out from under the MOB sensors. This results in loss of accuracy for the color registration system and possibly places the color registration targets out of range of the MOB sensors.

IOI Registration is constantly being monitored and adjusted in order to stay within tight specifications. If the MOB registration mark cursors are not realigned to the center of the MOB sensors, then the IOI registration system will move the image right back to where it started from before IOP registration Setup and the IOP registration would not be correct.

Further, because of drift in the system, repeated IOI registration setups are performed. Drift is caused by factors such as, for example, various noises in the system that cause the positions of the images shift over time. Temperature is the most significant noise, as the system heats up and cools down over time. MOB sensors are used for both monitoring and controlling the color to color or IOI registration and the MOB sensors also control the absolute lateral position of the image as well, which helps to maintain image to paper registration.

In embodiments, the position of the MOB registration mark cursors are adjusted to be under the MOB sensors again (to within cursor resolution limits) without altering the desired image-position for IOP registration. This allows a user to repeat an IOI or an IOP registration setup without repeating the other. The following equations are used by the controller 50 to position the MOB registration marks 32 so that they end up aligned under the MOB sensors.

The equations below assume that an IOI registration setup, such as that disclosed in U.S. Pat. No. 6,300,968, has already been performed, so there is already a known target value for MOB registration mark convergence to the MOBs. This is called the "offset" value. Also, the error between the offset value and the actual lateral position of the MOB registration marks is known. This is called the "residual" value. The residual value exists because the IOI registration convergence is never perfect, so there is always a small amount of left over error. The measurements discussed below were made based upon FIGS. 3–5.

Figure 3:
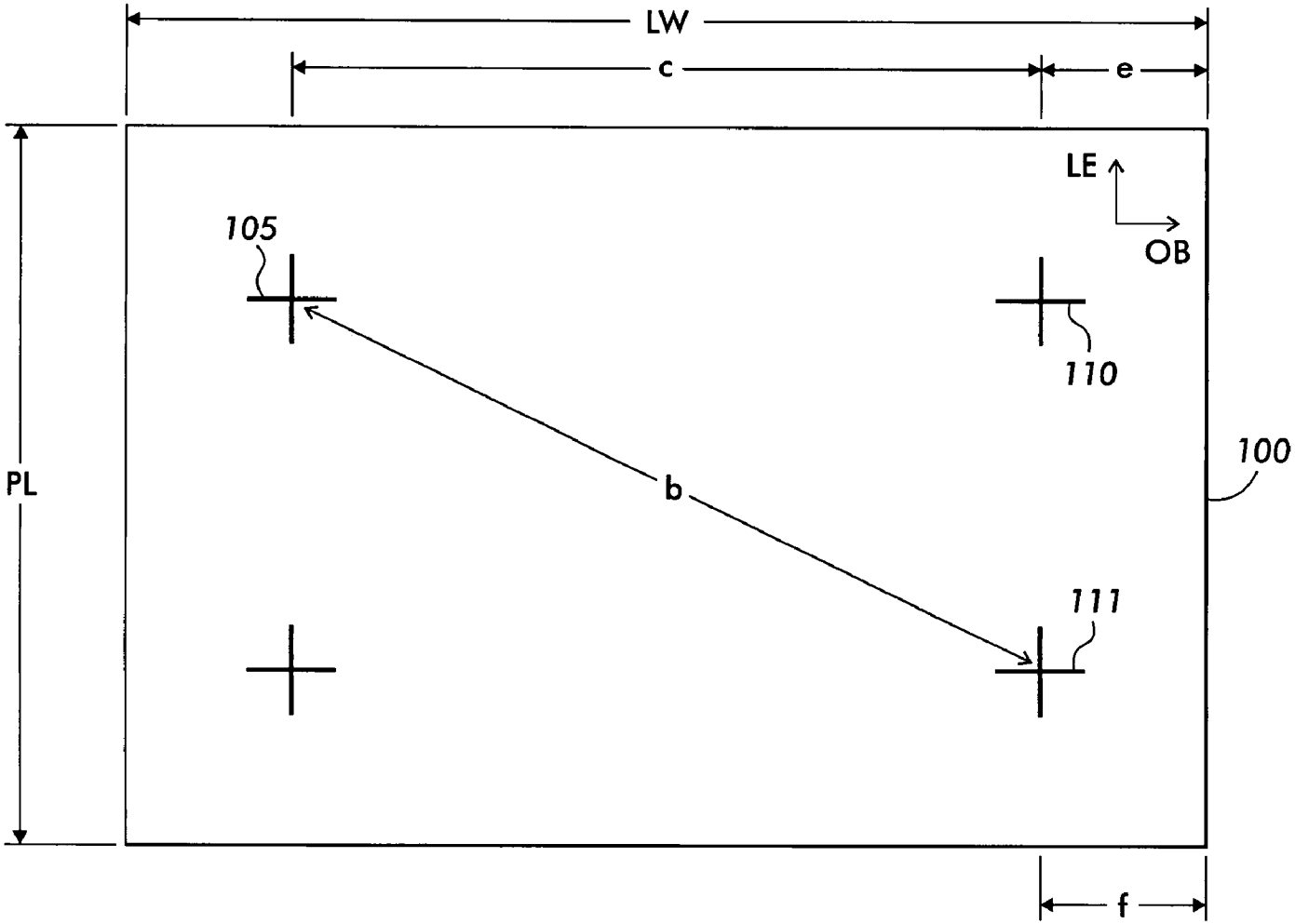
FIG. 3 is a top view of a sheet on which a registration test pattern has been printed.

FIG. 3 illustrates a sheet of paper 100 having a registration test pattern printed thereon. The test pattern includes multiple cross hairs including 105, 110, and 111.

Figure 5:
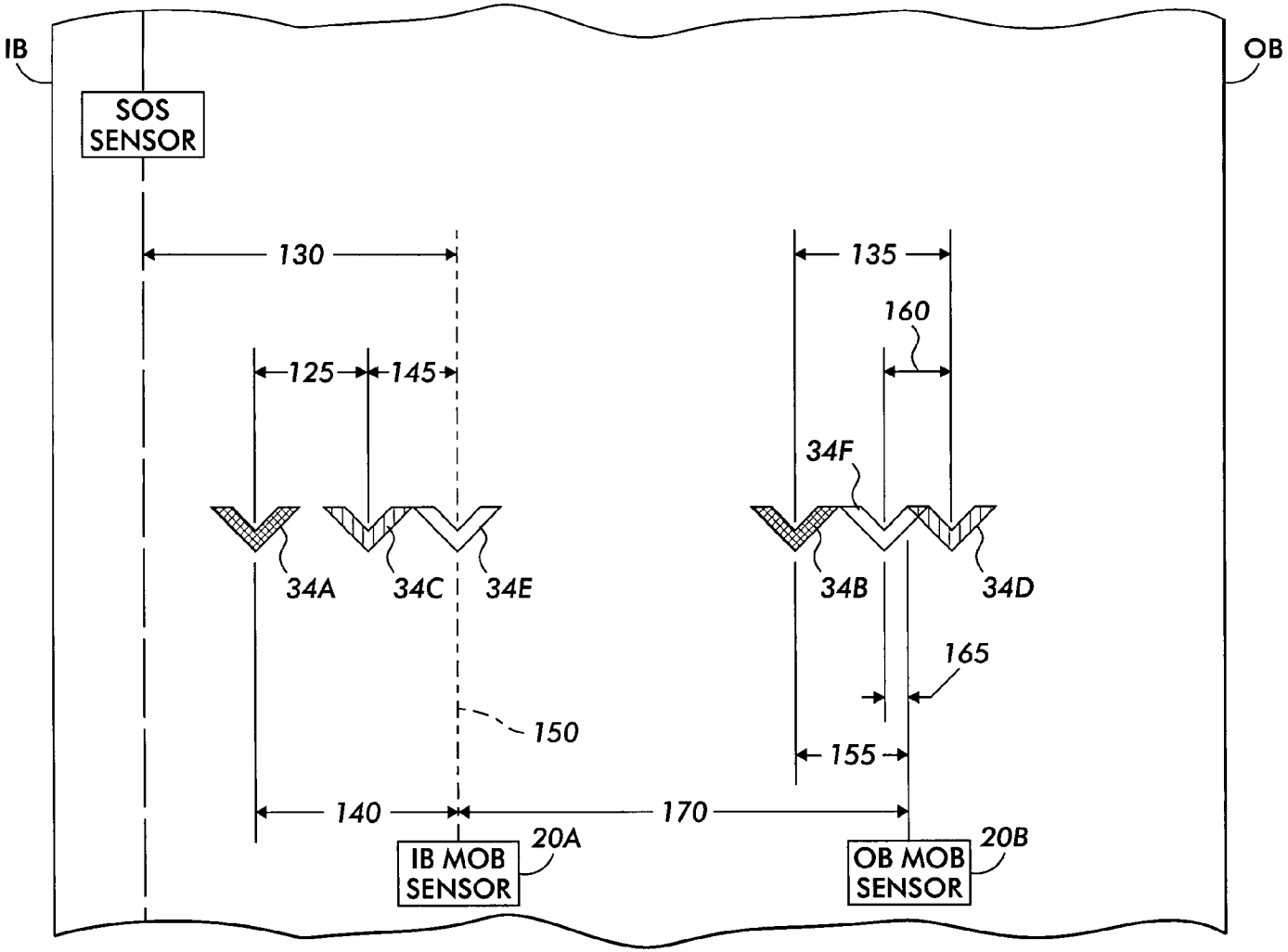
FIG. 5 is a schematic representation of a photoreceptor with MOB registration marks thereon.

FIG. 5 illustrates the photoreceptor belt 12 with multiple cursors drawn thereon. The two empty cursors 34E, 34F show the cursor target locations, which are as close to directly under the MOB sensors as possible. Because the cursor resolution is finite (i.e., the ROS has limits on how precisely it can place an image) it can only be positioned under the MOB sensor to within a certain degree of error. In embodiments, this error may be on the order of 100 microns. The two partially shaded cursors 34C, 34D represent the cursor position on the belt before an IOP registration setup. The two fully shaded cursors 34A, 34B represent the position of cursors after an IOP registration setup.

Figure 4:
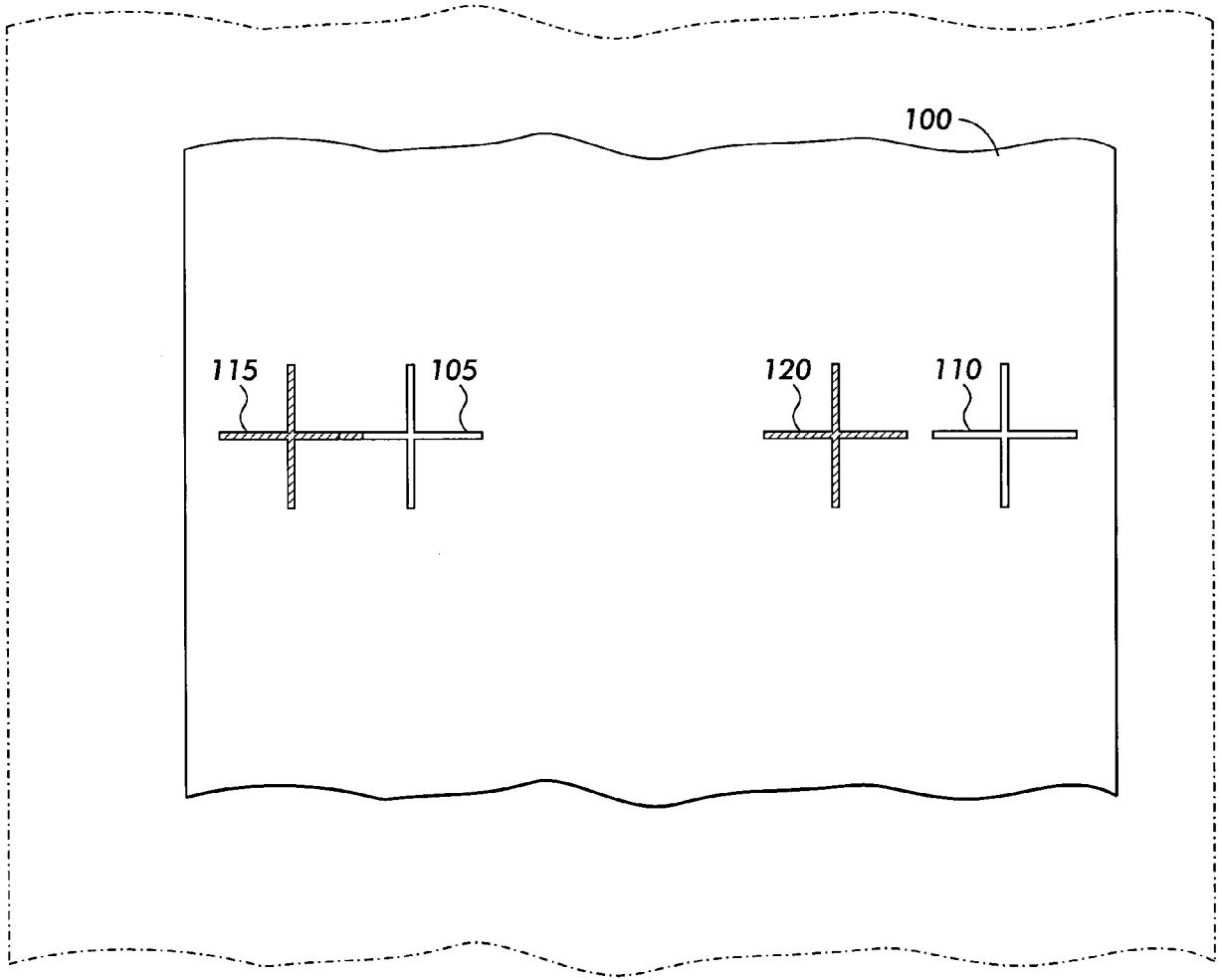
FIG. 4 is a top view of the upper portion of the sheet of FIG. 3 with images of the target locations the upper cross hairs superimposed on the image.

FIG. 4 illustrates a close up of the leading edge of a test sheet of FIG. 3, but also includes illustrations of the test registration marks 115, 120 in their desired locations. Both the lateral positional error and lateral magnification error can be calculated from FIGS. 3 and 4 by comparing the actual printed pattern to the desired printed pattern.

Determining the magnitude of the lateral magnification error requires first measuring the distance $C_{meas}$, illustratively expressed in millimeters, between the center of the inboard leading edge crosshair 105 and the center of the outboard leading edge crosshair 110. Then, the lateral magnification error (LME) is found by the equation:

$$LME=(C_{nom}-C_{meas})/C_{nom} \quad (1)$$

where $C_{nom}$ is the distance between desired location of the inboard leading edge cross-hair 115 and the desired location of the outboard leading edge cross-hair 120; i.e., $C_{nom}$ is the distance that would be measured if the cross hairs printed out on target.

The lateral positional error (LPE) is found by the following equation:

$$LPE=[E_{nom}-(E_{reg}+F_{reg})/2] \quad (2)$$

Where the $E_{nom}$ is the nominal distance from the crosshair 120 to the edge of the sheet and $E_{reg}$ and $F_{reg}$ are corrections to the measured values of E and F on the printed test pattern of FIG. 3. Methods for deriving $E_{reg}$ and $F_{reg}$ are described in detail in U.S. patent application Ser. No. 10/046,166, which has already been incorporated in its entirety.

Once the lateral position and magnification errors are known, (1) the lateral error in position between the actual inboard (IB) cursor position 34C and the post-IOP registration cursor position 34A (LIBE 125), and (2) the lateral error in position between the actual outboard (OB) cursor position 34D and the post-IOP registration OB cursor position 34C (LOBE 135) can be calculated. The former is given by the following:

$$LIBE=LPE-[SOSIBMOB*LME] \quad (3)$$

where SOSIBMOB 130 is the nominal distance from the ROS start of scan (SOS) sensor to the IB MOB sensor in microns. This distance will depend on the size and type of machine. In embodiments, the distance between the ROS SOS sensor and the MOB sensor will be on the order of 10,000 microns, i.e., a few centimeters. For example, the distance between the SOS sensor and the MOB sensor could be between 4 and 5 cm.

The lateral error in position between the actual OB cursor position and the desired OB cursor position for IOP registration is then given by the following:

$$LOBE=LPE-[(SOSIBMOB+MOBTOMOB)*LME] \quad (4)$$

where MOBTOMOB 170 is the nominal distance between the IB and OB MOB sensors in microns. Typically, the distance between the ROS SOS sensor and the MOB sensor will be on the order of 100,000 microns, i.e., tens of centimeters. In a particular experimental embodiment, this measurement equaled 30 cm. The sum of the nominal distance from the ROS SOS sensor to the IB MOB sensor and the nominal distance between the IB and OB MOB sensors equals the nominal distance from the ROS SOS sensor to the OB MOB sensor.

From the above, one can then calculate the lateral displacement of the IB and OB cursor positions from the IB MOB sensor after an IOP registration setup has been performed. The offset of the IB cursor is given by the following:

$$LIB\text{offset}=CLIBR+CLIB\text{offset}-LIBE \quad (5)$$

where LIBoffset 140 is the lateral displacement of the desired IB cursor position for IOP registration from the IB MOB Sensor 20A, CLIBR 145 is the lateral error from the IB cyan cursor after an IOI registration to the target IB cursor location, and CLIBoffset 150 is the lateral offset for cyan to the IB MOB Sensor 20A.

The lateral displacement of the desired IB and OB cursor positions for IOP registration from the IB MOB Sensor is given by the following:

$$LOB\text{offset}=CLOBR+CLOB\text{offset}-LOBE \quad (6)$$

where LOBoffset 155 is the lateral displacement of the desired OB cursor position for IOP registration from the OB MOB Sensor 20B, CLOBR 160 is the lateral error from the OB cyan cursor after an IOI registration to the target OB cursor location, and CLOBoffset 165 is the lateral offset for cyan to the OB MOB Sensor.

CLIBR 145 and CLOBR 160 are left over error in the position of the cyan-colored MOB registration marks after an IOI registration convergence. The MOB sensors can detect this value easily. The choice of cyan is arbitrary. Any of the colors can be chosen for a reference color. The residual error in the reference color causes the actual position of the cursors 34C, D to be different from the target positions 34E, F. The IOI registration setup registers the colors with respect to each other. Therefore the offset calculations need only be conducted with respect to one of the colors and then applied to each of the others. CLIBR and CLOBR are overwritten during image registration monitoring (MOB registration mark monitoring using the MOB sensors while a machine is in a productive state) with the running average of cyan lateral IB and OB error respectively.

CLIBoffset 150 and CLOBoffset 165 are the offsets between the cursor target location of a reference color (for example, cyan) relative to the position of the IB and OB MOB sensors 20A, 20B, respectively, for an IOI registration setup. The offset positions are also the positions that the reference color is checked against during a closed loop image registration control function in a productive state. These offsets are unavoidable as they depend on the cursor resolution of the particular machine. An ROS will typically only be able to place images such as cursors in N-pixel increments, where N is an integer. For example, an ROS may only be able to place images in 4-pixel increments across a belt. The CLIBoffset 150 and CLOBoffset 165 are each less than one half the cursor resolution of a machine (defined elsewhere in this application). The initial value of each of these offsets will be zero (as illustrated for the CLIBoffset 150 in FIG. 5), but each offset will change each time these calculations are performed.

From the LIBoffset and the LOBoffset, one can calculate the difference in pixels between the position of the IB cursor 34A after IOP registration setup and the target IB cursor location, which is the cursor location closest to the IB MOB sensor 20A, for IOP registration:

$$\text{Cursor}IBE=\text{ROUND}[(LIB\text{offset}/LMP)/\text{CursorRes}]*\text{CursorRes} \quad (7)$$

where CursorIBE is the change in pixel location that will position the post IOP registration IB cursor position to the desired IB cursor location, LMP represents the lateral size of each pixel, and CursorRes is the pixel resolution where the ROS Interface Module is able to place cursors. For example, in embodiments, a ROS interface module may only be able to write to within an accuracy of four pixels. Dividing the lateral displacement of the desired IB cursor position for IOP registration from the IB MOB Sensor 20A by LMP converts the lateral displacement of the IB cursor position from a unit of length into a number of pixels. This will vary from machine, to machine. For example, the width of a pixel (LMP) might be about 40–50 microns. Similarly:

$$\text{Cursor}OBE=\text{ROUND}[(LOB\text{offset}/LMP)/\text{CursorRes}]*\text{CursorRes} \quad (8)$$

where CursorOBE is the change in pixel location that will position the post IOP registration OB cursor position to the desired OB cursor location.

CursorIBE and CursorOBE are the lateral distances in pixels between where the cursors are placed after an IOP setup and the target position for the cursors. These values are then used to change where the MOB registration marks 32 are placed along each side (inboard and outboard) of the belt 12:

$$IB\text{CursorLoc}=IB\text{CursorLoc}-\text{Cursor}IBE \quad (9)$$

and $$OB\text{CursorLoc}=OB\text{CursorLoc}-\text{Cursor}OBE \quad (10)$$

where IBCursorLoc is the designated pixel location for the IB cursor, and OBCursorLoc is the designated pixel location for the OB cursor. Each image registration target has an individual NVM location to specify the IB and OB cursor locations. This calculation is used to position the MOB registration marks as well as both the standard and expanded chevron marks under the MOB sensors.

From the previously calculated values, we can also determine corrected offsets of a reference color such as, for example, cyan:

$$CLIB\text{offset}=LIB\text{offset}-\text{Cursor}IBE*LMP \quad (11)$$

and $$CLOB\text{offset}=LOB\text{offset}-\text{Cursor}OBE*LMP \quad (12)$$

The new cyan lateral inboard and outboard offsets serve as the new target points during image registration control, instead of aiming for the centerline of the IB MOB sensor.

When all these calculations have been completed, the cyan residual values shall be set equal to zero. This prevents the residual from being counted again on the next iteration of an IOP registration setup. We assume that the cursors are now exactly at the new cyan offset location, with no additional residual error.

$$\text{CLIBR}=0 \quad (13)$$

and $$\text{CLOBR}=0 \quad (14)$$

The new Cyan lateral offsets (CLIBoffset and CLOBoffset) are now used as the new adjusted targets during image registration monitoring, and with any subsequent image registration setup phases. The requirements that follow allow for transition between IOI registration setup, IOP registration setup, and image registration maintenance mode, without requiring the user to do unnecessary or additional setups. So, once IOP registration has been setup, the user can perform another IOP registration setup without having to go through a full IOI registration setup. The user can also go through a full IOI registration setup without having to perform another IOP registration setup.

The target value for each chevron is now equal to the cyan lateral offsets. The offset value is chosen as the closest point to directly under the MOB sensor as possible. Placement of the MOB registration marks directly under the MOB sensors is limited by the cursor resolution of the machine. The system will only allow cursor movements in N pixel increments. This offset can be accounted for by calculating the offsets of the cursors to the MOB sensors after the cursor movement. This offset can then be remembered and maintained.

During the IOI setup, the cyan lateral offset values shall be used as the adjustment target for each color (M, Y, C, K). In other words, the target lateral position of each color shall be adjusted to the cyan lateral offset values (IB and OB). The cyan lateral offset values are used as targets during the initial gross registration phase, the expanded chevron phase (if expanded chevrons are used), and the, standard chevron phase.

After each iteration of the standard chevron phase, the average measurement of cyan to the cyan offset values shall be stored in the NVM locations for the cyan lateral residual values (CLIBR and CLOBR).

The image registration maintenance mode is the closed loop image registration controller that is activated during job production. This mode monitors standard chevrons using the MOB sensors in a designated zone on the PR belt. The monitoring occurs once every second belt revolution, allowing two-pass cleaning for the MOB registration marks since they are not being transferred. The misregistration of the reference color (for example, cyan) is calculated relative to the MOB sensors, as well as the color misregistration of all other colors (for example, magenta, yellow, and black) to the reference color. This allows detection of absolute image placement drift, and color to color drift. If the drift exceeds an allowable threshold, printing is suspended, and an image registration setup is invoked in order to re-converge.

During the image registration maintenance mode, the running averages of the cyan lateral measurements to the cyan lateral offsets shall be stored in the NVM locations for the cyan lateral residual values (CLIBR and CLOBR). These values shall be updated whenever the running averages are updated.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention.

What is claimed is:

1. A method for locating select multi-color images on a belt after an image on paper registration process, comprising:

generating a test pattern;

printing a test pattern;

measuring at least one test pattern parameter;

using the at least one test pattern parameter to determine a lateral distance required to shift a first registration mark having a first color to a desired location on the belt;

shifting the first registration mark to the desired location on the belt, and using the lateral distance determined for the first registration mark to shift the placement of a second registration mark having a second color different from the first color on the belt, wherein the first registration mark and the second registration mark are used to locate a first color separation of the image and a second color separation of the image on the belt.

2. The method of claim 1, wherein the at least one test pattern error includes a lateral magnification error and a lateral positional error.

3. The method of claim 1, wherein the step of shifting the first registration mark to the desired location is done during a gross registration phase, or an expanded chevron phase, or a standard chevron phase of image on image setup, or any combination of the three phases.

4. The method of claim 1, further comprising detecting a residual error in the lateral location of the first registration mark after an image on image registration setup:

using the residual error in conjunction with the at least one test pattern parameter to determine the lateral distance required to shift the first registration mark to a desired location on the belt.

5. The method of claim 4, wherein the method is used to shift an inboard registration mark of the first color with respect to an inboard MOB sensor and an outboard registration mark of the first color with respect to an outboard MOB sensor.

6. The method of claim 4, wherein the residual error is set to zero after the method is performed.

7. The method of claim 1, wherein detecting the residual error in the lateral location of the first registration mark is accomplished by a MOB sensors.

8. The method of claim 1, wherein the first color is cyan.

9. The method of claim 1, wherein the lateral distance determined for the first registration mark is used to shift the placement of third and fourth registration marks having third and fourth colors respectively on the belt, wherein the third and fourth colors are each different from the first and second colors as well as different from each other.

10. The method of claim 9, wherein the third registration mark and the fourth registration mark are used to locate a third color separation of the image and a fourth color separation of the image on the belt.

11. The method of claim 10, wherein a composite of the first, second, third, and fourth color separations is simultaneously transferred to a final substrate.

12. An IOI registration system, comprising:

an initial gross registration mode including a plurality of first registration marks imaged on an image bearing surface, imaging said first registration marks on said image bearing surface until an initial gross registration is achieved, a second registration mode in which said color registration system automatically images a plurality of second registration marks on said image bearing surface, wherein the lateral target position of the marks is shifted relative to the MOB sensors in each of the initial and second registration modes based upon the measurement of at least one test pattern parameter and at least one imaging error.

* * * * *